US009022696B2

(12) United States Patent
Wiedenmann

(10) Patent No.: US 9,022,696 B2
(45) Date of Patent: May 5, 2015

(54) DEVICE AND METHOD FOR INTRODUCING A FILLING MATERIAL

(71) Applicant: Bauer Spezial Tiefbau GmbH, Schrobenhausen (DE)

(72) Inventor: Ulli Wiedenmann, Schrobenhausen (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 14/030,988

(22) Filed: Sep. 18, 2013

(65) Prior Publication Data

US 2014/0086692 A1 Mar. 27, 2014

(30) Foreign Application Priority Data

Sep. 26, 2012 (EP) ..... 12006722

(51) Int. Cl.

| | |
|---|---|
| ***E02D 5/38*** | (2006.01) |
| ***E02D 3/12*** | (2006.01) |
| ***E02D 15/04*** | (2006.01) |
| ***E02D 5/34*** | (2006.01) |

(52) U.S. Cl.

CPC *E02D 3/12* (2013.01); *E02D 15/04* (2013.01); *E02D 5/34* (2013.01)

(58) Field of Classification Search

USPC ..... 405/269, 235–238, 240, 243; 222/460, 222/527, 632; 141/331

See application file for complete search history.

(56) References Cited

U.S. PATENT DOCUMENTS 4,166,508 A * 9/1979 Van Den Berg ..... 175/20

FOREIGN PATENT DOCUMENTS

| | | |
|---|---|---|
| DE | 1113427 | 8/1961 |
| JP | 06200528 A * | 7/1994 |

* cited by examiner

*Primary Examiner* — Sunil Singh
(74) *Attorney, Agent, or Firm* — Studebaker & Brackett PC

(57) ABSTRACT

A device for introducing a filling material into a hole in the ground, with a channel-like filling section which can be introduced into the hole and has an upper feed opening for feeding in the filling material and a lower discharge opening for discharging the filling material in a lower area of the hole. The filling section includes an upper feed section and a flexible hose section arranged below. During the filling of the hole with the filling material the flexible hose section can be moved upwards along the feed section. During upward movement of the flexible hose section a severing device severs an upper area of the hose section in a longitudinal direction. Furthermore, the invention relates to a method for introducing a filling material into a hole.

15 Claims, 1 Drawing Sheet

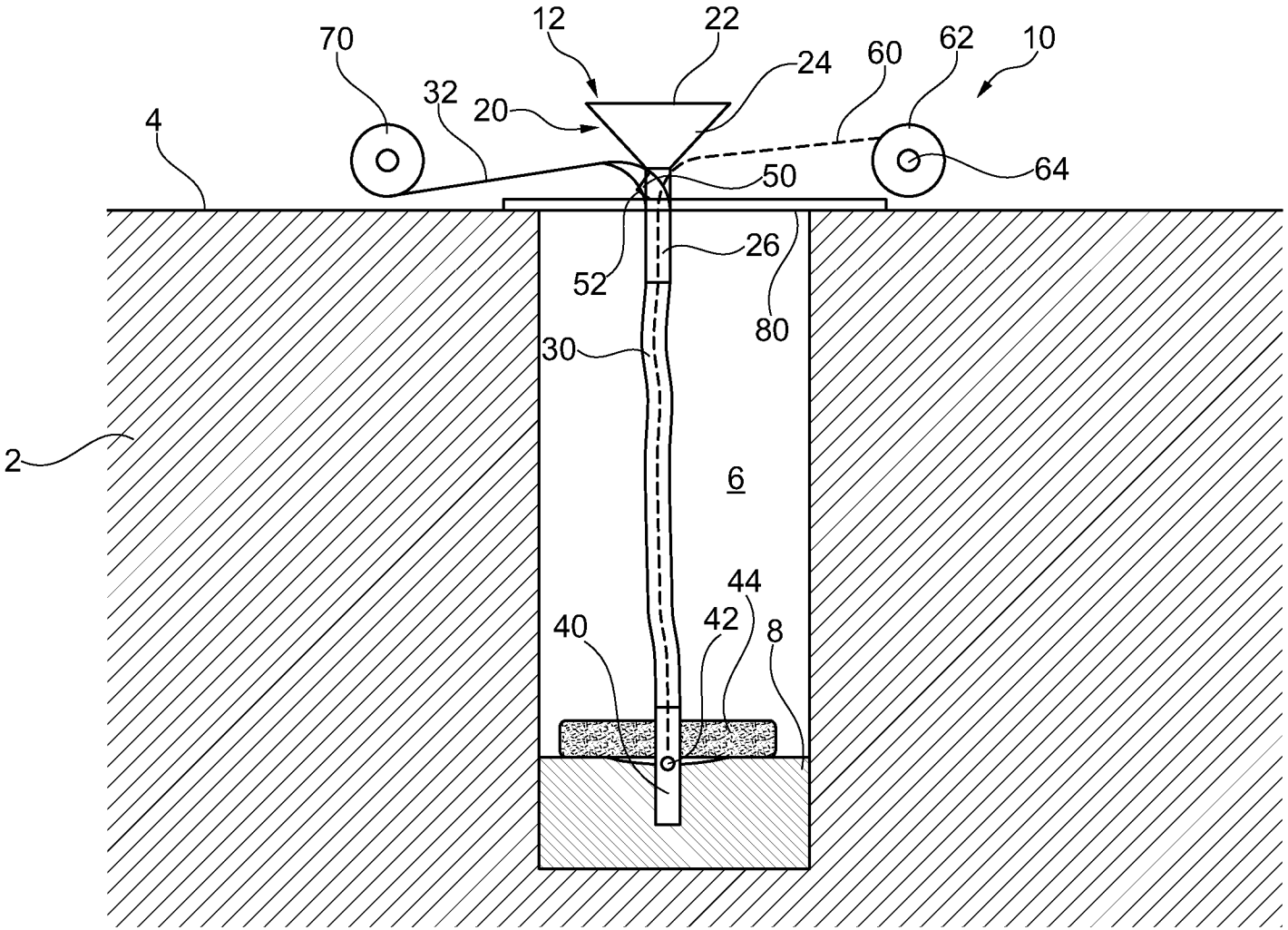
10
64
62
60
24
22
12
20
32
70
4
50
26
80
52
30
6
44
42
8
40
2

DEVICE AND METHOD FOR INTRODUCING A FILLING MATERIAL

FIELD OF THE INVENTION

The invention relates to a device for introducing a filling material into a hole in the ground. The device comprises a channel-like filling means which can be introduced into the hole and has an upper feed opening for feeding in the filling material and a lower discharge opening for discharging the filling material.

Furthermore, the invention relates to a method for introducing a filling material into a hole in the ground, in which a channel-like filling means is introduced into the hole, the filling material is fed through an upper feed opening into the filling means and discharged or introduced via a lower discharge opening into the hole.

BACKGROUND OF THE INVENTION

Devices of the stated type are employed, in particular, for the production of so-called bored piles, panels, cut-off walls or the like. Initially, a hole is produced in the ground, for example through drilling or cutting. The hole is usually stabilized by means of a stabilizing liquid. Afterwards, the hole is filled up from the bottom with a filling material, for instance plaster, gravel, sand or concrete. In this process, the discharge opening is guided upwards in line with the rising filling level. The stabilizing liquid is displaced upwards and normally led off in a controlled manner.

To fill a hole in the ground various types of filling pipes are known. For example DE 701 932 describes an extensible filling pipe which comprises several pipe parts inserted telescopically into one another, of which the uppermost one has a receiving hopper for concrete and the lowermost one has a pipe mouth.

A filling pipe for introducing underwater concrete is described in DE 1 113 427. This filling pipe comprises a feed hopper and several detachable pipe pieces connected thereto which can each be dismantled into two shells. In the concreting process the filling pipe is pulled upwards. The shells of the uppermost pipe piece are removed sideways so that the following pipe piece can move up.

Another device and a method for introducing a hardening mass underwater is known from DE 1 928 993. In this case, a flexible hose or duct is used as a filling pipe which, by the action of the surrounding water pressure, is compressed so that a uniform outflow of the hardening mass can be realized underwater. The handling of the filling pipes above the hole and the devices required for this prove to be elaborate and complex.

SUMMARY OF THE INVENTION

The invention is based on the object to provide a device and a method for introducing a filling material into a hole in the ground, which enable a particularly efficient filling.

According to the invention the device is characterized in that the filling means has an upper feed section and a flexible hose section arranged below, in that during the filling of the hole with the filling material the flexible hose section can be moved upwards along the feed section and in that a severing means is provided, with which an upper area of the flexible hose section can be severed along a longitudinal direction during its upward movement.

The method, which is especially suitable for producing a foundation or sealing element and can be carried out, in particular, by means of a device according to the invention, is characterized in that during the filling of the hole a flexible hose section of the filling means is moved upwards along an upper feed section and in that during upward movement an upper area of the flexible hose section is severed along a longitudinal direction by means of a severing means.

A fundamental idea of the invention can be seen in the fact that a flexible filling hose is provided, through which the filling material is guided into a lower area of the hole to be filled. Compared to a rigid pipe, a hose is light in weight and can be produced in a cost-efficient manner.

A further fundamental idea of the invention resides in the fact that the filling hose is severed at its upper end in order to thereby achieve a shortening of the effective hose section, through which the filling material is guided. Moreover, the handling is facilitated considerably during extraction.

Consequently, complex constructions, as for example telescopic pipes or the like, can be dispensed with. Especially in the case of deep trenches or boreholes the efficiency of the method is increased by preferably making use of a disposable filling hose.

The severing of the hose is effected during the filling of the hole while the hose is being pulled up so that the hose length below the severing is shortened continuously. Due to the continuous severing of the hose the feed section can be installed in a fixed position in relation to the hole.

The severing means can be arranged in a fixed manner on the upper feed section of the filling means. By preference, the flexible hose section can be pulled up in its entirety along the severing means and severed at the fixed position of the severing means. After severing, the hose section is present as a severed hose section or hose remains. The severed hose remains can be selectively led away from the feed section and undergo recycling for example.

By severing the hose wall a lateral access is provided in the wall, through which the filling material can be introduced into the hose section. Due to the progressive severing the access moves along the hose so that the length between access and lower hose end is shortened progressively during the upward movement of the hose section.

By preference, on the feed section of the filling means a guide section is designed, which guides the hose section during its upward movement, in particular leading it towards the severing means. The guide section is preferably located below the severing means and can be of pipe-shaped design in particular.

Basically, the severing of the hose section can be carried out in any chosen manner, for example by tearing open and/or pulling the hose apart along its longitudinal axis. In a preferred embodiment the severing means is designed as a cutting means with a cutting edge.

A reliable severing of the flexible hose section during its upward movement can be achieved in that the cutting edge of the cutting means is directed downwards in the direction of a lower area of the filling means. By preference, the cutting edge extends parallel to a longitudinal axis of the filling means and is capable of being advanced.

To feed in the filling material it is preferred that the feed section has a feed hopper. The severing means for severing the flexible hose section is preferably arranged below the feed hopper. The severing means below the feed hopper enables the flexible hose section to be opened or severed below the feed hopper and to be specifically guided past the feed hopper which is preferably installed in a fixed manner. Above the severing means a lead-off section can be designed that leads the hose section away from or past the feed hopper.

In accordance with the invention provision is made in particular in that the flexible hose section is guided in a displaceable manner along the feed section. For this purpose, the feed section preferably has a guide section, along which the flexible hose section is guided in a displaceable manner, in particular along its longitudinal axis. The guide section can comprise a pipe-shaped piece which projects into the flexible hose section and on which the flexible hose section slides along. The feed section is preferably installed in a fixed manner above the hole to be filled.

Below the flexible hose section the filling means preferably has a pipe section which is of rigid type in particular and on which the discharge opening is designed. By preference, the pipe section fixed at the lower end of the disposable filling hose is preferably reusable and for this purpose is preferably connected in a detachable manner to the hose section. The reusable mouth piece with discharge opening increases the efficiency of the device and the method. The pipe section is preferably dimensioned such that due to its weight it automatically aligns itself vertically so that a defined alignment of the discharge opening can be ensured.

For a uniform discharge of material from the filling means it is advantageous if the filling means protrudes permanently to a specific extent into the section of the hole already filled. In order to ensure this a floating body can be fixed in a lower area of the filling means, which is designed to raise the lower area of the filling means in the hole as a function of a filling degree of the hole. It is especially preferred that the floating body is fixed to the lower, in particular rigid pipe section of the filling means. In this way, a vertical alignment of the pipe section can be fostered and a uniform discharge of the filling material from the filling means can be reliably achieved.

Additionally or alternatively to the floating body a pull rope for raising the flexible hose section can be provided. The pull rope is preferably fixed in a lower area of the filling means, more particularly at a lower end of the flexible hose and/or on the lower rigid pipe section below the hose.

By preference, a winch is provided for pulling and/or receiving the pull rope. The pull rope runs outside or inside the flexible hose section of the filling means and is led out of the hose above the severing means. The winch is preferably located laterally next to the filling means or rather next to the hole to be filled.

According to the invention it is furthermore preferred that a measuring means for determining a depth of a fixing point of the pull rope on the filling means is provided. The depth measurement permits a selective tracking of the filling hose.

For a space-saving storage of the severed, flexible hose section a means for winding up the severed, flexible hose section is preferably provided. The winding means is preferably located laterally next to the hole in the ground to be filled and can comprise a winch or roll in particular.

The wall thickness and material of the flexible hose section are preferably chosen such that the hose section, after having been severed, can be wound in a substantially flat manner onto the winch or roll. In this way, the hose or film remains are easy to store.

The flexible hose section preferably comprises a plastic and/or textile hose. Because of the singular one-time usage, the wall thickness of the hose section can be chosen relatively thin so that the hose section can also be referred to as a film hose. This enables the severed hose remains to be wound onto the winch or roll.

Especially with regard to the use in a hole filled with liquid, for instance a borehole filled with a stabilizing liquid, it is preferred that the filling means, more particularly the hose section, is designed in a fluid-tight manner. In particular, the fluid-tightness is designed such that preferably no liquid can get from the hole into the filling means.

The severing can be facilitated in that the flexible hose section of the filling means has a defined material weakening for severing along its longitudinal axis. In particular, the defined material weakening can be a thinning of the material or a perforation of the hose section.

In the following the invention is described further by way of a preferred embodiment illustrated schematically in the accompanying Figure, which shows:

BRIEF DESCRIPTION OF THE DRAWINGS

FIG. 1 a cross-sectional view of a device according to the invention for introducing a filling material into a hole in the ground.

DETAILED DESCRIPTION OF THE PREFERRED EMBODIMENTS

The device 10 comprises a channel-like filling means 12 for introducing a filling material 8 into a hole 6 in the ground 2. To this end, the channel-like filling means 12 is introduced into the hole 6 and extending therein in a substantially vertical manner.

The filling means 12 comprises at its upper end a substantially dimensionally stable or rigid feed section 20 for feeding in the filling material 8. For this purpose, the feed section 20 is provided with a feed hopper 24 which has a funnel-shaped feed opening 22. Below the feed hopper 24 a guide section 26, for example designed in a pipe-shaped manner, is formed, on which a hose section 30 is supported in a displaceable manner. In the illustrated embodiment the guide section 26 protrudes into the hose section 30 in order to pass the filling material 8 fed into the feed hopper 24 onwards into the hose section 30. In other words, the flexible hose section 30 is guided in a linearly displaceable manner on an exterior of the guide section 26.

Below the feed hopper 24, located in the area of or above the guide section 26 a severing means 50 is designed which projects outwards from the guide section 26 and comprises a downward-directed cutting edge 52 for severing the hose section 30. The cutting edge 52 extends transversely to a longitudinal axis of the guide section 26 or the hose section 30.

The hose section 30 extends in an approximately vertical manner inside the hole to be filled. Below the hose section 30 a pipe section 40 is fixed on the hose section 30. The dimensionally stable or rigid lower pipe section 40 is submerged in the area of the hole 6 already filled and comprises a discharge opening 42 for discharging the filling material 8 from the filling means 12 and for introducing it into the hole 6. On the outside of the pipe section 40 a floating body 44 is fixed, which is adapted to float on the filling material 8 located in the hole 6 and to raise the pipe section 40 with an increasing filling degree of the hole 6. By raising the pipe section 40 the hose section 30 is also raised with it and is guided along the guide section 26.

Through the cutting means 50 the hose section 30 is severed below the feed hopper 24 along its longitudinal axis. As a result, the hose section 30 can be bent open and led away from the feed section 20, in particular the feed hopper 24. In the illustrated embodiment the severed hose section 30, which can also be referred to as severed hose or film remains 32, is led into a lateral area and wound onto a means 70. The means 70 for receiving the hose remains 32 can have a roll or winch in particular, onto which the hose remains 32 can be wound.

In particular, the means 70 can also be used to pull the hose section 30. By pulling on the hose remains 32 a pull force is applied to the hose section 30, which pulls the hose section 30 up along the guide section 26 and the severing means 50.

Moreover, a pull rope 60 can be provided to raise the hose section 30 and/or the pipe section 40. In the illustrated embodiment the pull rope 60 is fixed on the lower pipe section 40 and extends through the interior of the hose section 30. Above the severing means 50 the pull rope 60 is guided out of the hose section 30 towards a winch 62. The latter pulls the pull rope 60 upwards and winds it up. The winch 62 comprises a measuring means 64 for depth measurement. By way of the measuring means 64 the position of the lower pipe section 40 and/or the discharge opening 42 of the filling means 12 can be determined.

The channel-like filling means 12 is held on a holding means 80 above the hole 6. The holding means 80, which is supported on a ground surface 4, carries the filling means 12 and holds the feed section 20 in a fixed, defined position. The means 70 for winding up and/or pulling the hose section 30 and the winch 62 for the pull rope can be installed on the ground surface 4.

To fill a hole, for instance a borehole or a cut trench, in the ground the filling means 12 is installed in the hole and filling material 8 is fed into the feed opening 22. The lower pipe section 40 is kept at a boundary surface between the filling material in the hole and the stabilizing liquid lying above where appropriate so that the discharge or feed opening 42 lies below the boundary surface. During the filling the flexible hose section 30 is pulled upwards, severed at the severing means 50 below the feed hopper 24 and guided past the feed hopper 24. The severed hose remains 32 are wound onto a roll.

All in all, by making use of a disposable hose a highly efficient filling of a hole in the ground can be accomplished especially in the case of particularly deep trenches or boreholes. Disposable hoses, in particular made of plastic, can be manufactured at low cost, are light-weight as compared to commonly used pipes and can be handled without great effort. Moreover, by severing the hose complicated telescopic mechanisms or other pipe shortening elements can be dispensed with.

The invention claimed is:

1. Device for introducing a filling material into a hole in the ground, said device comprising a channel-like filling means to be introduced into the hole and having an upper feed opening for feeding in the filling material and a lower discharge opening for discharging the filling material, the channel-like filling means having an upper feed section and a flexible hose section arranged below, the upper feed section so that during the filling of the hole with the filling material the flexible hose section is moved upwards along the feed section, and a cutting device located on the channel-like filling means with which an upper area of the flexible hose section is cut along a longitudinal direction during its upward movement of the flexible hose section, the flexible hose section extending longitudinally for engagement with the cutting device and cutting by the cutting device.

2. Device according to claim 1, wherein the cutting device includes a cutting edge.

3. Device according to claim 2, wherein the cutting edge of the cutting device is directed downwards in a direction of a lower area of the filling means.

4. Device according to claim 1, wherein the upper feed section has a feed hopper and the cutting device is arranged below the feed hopper.

5. Device according to claim 1, wherein the upper feed section has a guide section, along which the flexible hose section is guided in a displaceable manner.

6. Device according to claim 1, wherein below the flexible hose section the filling means has a pipe section, on which the discharge opening is located.

7. Device according to claim 1, wherein in a lower area of the filling means a floating body is fixed, which raises the lower area of the filling means in the hole as a function of a filling degree of the hole.

8. Device according to claim 1, wherein a pull rope for raising the flexible hose section is provided.

9. Device according to claim 8, wherein a winch for pulling and/or receiving the pull rope is provided.

10. Device according to claim 8, wherein a measuring means for determining a depth of a fixing point of the pull rope on the filling means is provided.

11. Device according to claim 1, wherein a means for winding up the severed, flexible hose section is provided.

12. Device according to claim 1, wherein the flexible hose section includes a plastic and/or textile hose.

13. Device according to claim 1, wherein the filling means is designed in a fluid-tight manner for use in a hole filled with liquid.

14. Device according to claim 1, wherein for severing along its longitudinal axis the flexible hose section of the channel-like filling means has a defined material weakening.

15. Method for introducing a filling material into a hole in the ground by a device according to claim 1, wherein the channel-like filling means is introduced into the hole, the filling material is fed through the upper feed opening into the channel-like filling means and discharged via the lower discharge opening into the hole, wherein during the filling of the hole the flexible hose section of the filling means is moved upwards along the upper feed section, and during upward movement the upper area of the flexible hose section is cut along a longitudinal direction by the cutting device.

* * * * *